US011427373B2

(12) United States Patent
Renk et al.

(10) Patent No.: US 11,427,373 B2
(45) Date of Patent: Aug. 30, 2022

(54) RECLOSABLE FROZEN FOOD PACKAGING CASE

(71) Applicant: General Mills, Inc., Minneapolis, MN (US)

(72) Inventors: Zachary Renk, Minneapolis, MN (US); Tal A. Tostenson, Rogers, MN (US)

(73) Assignee: General Mills, Inc., Minneapolis, MN (US)

( * ) Notice: Subject to any disclaimer, the term of this patent is extended or adjusted under 35 U.S.C. 154(b) by 5 days.

(21) Appl. No.: 16/944,457

(22) Filed: Jul. 31, 2020

(65) Prior Publication Data

US 2022/0033130 A1 Feb. 3, 2022

(51) Int. Cl.
*B65D 5/02* (2006.01)
*B65B 7/24* (2006.01)

(52) U.S. Cl.
CPC ..... *B65D 5/0254* (2013.01); *B65B 7/24* (2013.01); *B65D 5/0236* (2013.01)

(58) Field of Classification Search
CPC .. B65D 5/0254; B65D 5/0236; B65D 5/4212; B65D 5/4208; B65B 7/24
USPC ..... 229/156–157; 53/491
See application file for complete search history.

(56) References Cited

U.S. PATENT DOCUMENTS 2,053,857 A 9/1936 Weiss
2,361,603 A * 10/1944 Cohen ..... B65D 5/10 229/185
2,663,491 A * 12/1953 Hill ..... B65D 5/10 229/157
4,119,266 A 10/1978 Dempster
4,291,827 A 9/1981 Mulroy
4,367,840 A * 1/1983 McFadden ..... B65D 5/4608 229/157
4,386,729 A 6/1983 Schmidt
4,650,112 A 3/1987 Booth
5,046,662 A 9/1991 Cowles
5,104,035 A 4/1992 Rosenbaum, II
5,318,220 A * 6/1994 Gagliardo ..... B65D 5/10 229/185

(Continued)

FOREIGN PATENT DOCUMENTS

EP 1498356 1/2005
EP 1498356 A2 * 1/2005 ..... B65D 5/10
WO WO-2007074412 A2 * 7/2007 ..... G06Q 30/02

OTHER PUBLICATIONS

Machine Translation of EP 1,498,356 A2 (Year: 2005).*

*Primary Examiner* — Nathan J Newhouse
*Assistant Examiner* — Phillip D Schmidt
(74) *Attorney, Agent, or Firm* — Diederiks & Whitelaw, PLC; John L. Crimmins, Esq.

(57) ABSTRACT

A reclosable packaging case for transporting or storing a product, such as a frozen food product, has minimal gaps upon reclosers of the packaging case. The reclosable packaging case has portions of one or more outer top flaps bent and inserted into openings in one or more inner top flaps. The portions, e.g., corner portions, of the one or more outer flaps are bent at pre-established angles and locations to align with the openings in the one or more inner flaps to ensure minimal gaps in the packaging case once the portions have been inserted into the openings in the inner top flaps, thereby assuring the minimal gaps to help preserve the quality of the product.

17 Claims, 5 Drawing Sheets

(56) References Cited

U.S. PATENT DOCUMENTS

| | | | | |
|---|---|---|---|---|
| 7,481,354 | B2 | 1/2009 | Kawagoe et al. | |
| 8,133,163 | B2 | 3/2012 | Strong et al. | |
| 8,998,072 | B2 | 4/2015 | Whittles et al. | |
| 9,016,556 | B2 | 4/2015 | Hirsh | |
| 2010/0094238 | A1* | 4/2010 | Scarano | B65D 27/14 604/385.13 |
| 2016/0075465 | A1* | 3/2016 | Wiley | B65D 5/0015 206/509 |
| 2019/0270539 | A1 | 9/2019 | Muse et al. | |

* cited by examiner

RECLOSABLE FROZEN FOOD PACKAGING CASE

FIELD OF THE INVENTION

The present invention generally pertains to reclosable packaging cases. More particularly, the present invention relates to a reclosable packaging case, particularly for transporting and storing frozen food products such as frozen dough products, a blank for forming the reclosable packaging case and a method of forming or closing the reclosable packaging case.

BACKGROUND OF THE INVENTION

Freezers (e.g., walk-in freezers, reach-in freezers, etc.) play pivotal roles in many food service businesses such as restaurants or cafeterias. Freezing preserves food for extended periods of time until the food is ready to be used. Specifically, freezing prevents the growth of microorganisms that cause food spoilage and foodborne illness. In the food service industry, various types of food are frozen, including raw meat/seafood, pre-cooked meat/seafood, desserts, pre-baked baked goods and dough/batter for baked goods.

Food stored in a freezer continuously at or below 0° F. can be kept in the freezer essentially indefinitely from a safety perspective. However, from a quality perspective, frozen foods are typically stored in a freezer for a couple months, perhaps up to a year depending on the food product. Food stored beyond these time frames can lose color, texture and flavor for various reasons. However, food stored within these time frames can still experience some form of quality loss.

In the food service industry, foods that are to be stored in freezers are often packaged in cardboard boxes. However, when such boxes are reclosed after being initially opened, substantial gaps in the packaging typically occur. Food products that continue to be freezer stored in the reclosed boxes have an increased potential for quality deterioration due to the gaps in the packaging. If a frozen food loses moisture (e.g., via gaps in its packaging) as it is stored in the freezer, the food can develop an undesirable dried surface condition known as "freezer burn". Additionally, oxygen present in the freezer can interact with the frozen food (e.g., via gaps in its packaging) and cause changes to the flavor and color of the frozen food. With the above in mind, there is a need in the art to minimize quality loss of food stored in freezers and to maximize the period of time food can be stored in a freezer without losing quality.

SUMMARY OF THE INVENTION

In accordance with the present invention, a reclosable packaging case is provided wherein any gaps which occur upon reclosure of the packaging case are minimized. The reclosable packaging case features one or more inner top flaps for selectively covering the interior of the case and one or more outer top flaps for selectively covering the inner top flaps, where portions of the outer top flaps are configured to be bent and inserted into openings in the inner top flaps. In particular, the portions of the outer flaps are configured to be bent at pre-established angles and locations to align with the openings in the inner flaps to ensure minimal gaps in the packaging case once the outer flap portions have been inserted into the openings in the inner top flaps.

In one embodiment, the reclosable packaging case includes four interconnected panels folded to establish an interior of the packaging case into which a product is to be loaded. Two inner top flaps selectively cover the interior and two outer flaps selectively cover the inner top flaps. Each outer top flap has two corner portions configured to be bent along corner fold lines and inserted into openings established in the inner top flaps. The angles and locations of the corner fold lines in the outer top flaps and the openings in the inner top flaps are pre-established such that the reclosable packaging case has minimal gaps once the corner portions have been inserted into the openings in the inner top flaps. Preferably, the inner and outer top flaps are rectangular in shape and the corner fold lines and the openings are angled approximately 45° from the rectangular edges of their respective flaps. Preferably, when each corner portion is bent along its corner fold line relative to an outer top flap and inserted into a respective opening in an inner top flap, the corner portion is angled approximately 15° or less from the outer top flap.

In another embodiment, a reclosable packaging case includes graphics upon its inner and outer top flaps for indicating whether the reclosable packaging case is properly closed or reclosed. Each of the one or more outer top flaps of the reclosable packaging case has an outer top graphic that complements an inner top graphic on an inner top flap of the packaging case. When a portion of an outer top flap is correctly inserted into a corresponding opening in an inner top flap, the outer top flap's graphic and the inner top flap's graphic together establish an image that indicates to a user that the packaging case has been properly closed or reclosed and with its minimal gaps.

The invention also encompasses a unitary blank for forming the reclosable packaging case. In one embodiment, the blank includes four interconnected panels, each panel having a top flap and a bottom flap. Two of the top flaps have two corner portions, where each corner portion is at least partially defined by a corner fold line having a pre-established angle and location. Each of the other top flaps has two separate perforation patterns, with each perforation pattern defining a portion of the top flap that is to be at least partially detached from the top flap to form an opening during a method of forming a reclosable packaging case or a method of reclosing the packaging case. Preferably, each portion of a top flap defined by a perforation pattern is only to be partially detached from the top flap in order to establish a hinged tab that defines, at least in part, the formed opening. The locations and angles of the longitudinal axes of the perforation patterns are pre-established and complement the corner fold lines such that, once the blank is formed into the reclosable packaging case and the corner portions have been inserted into the openings in the inner top flaps, the reclosable packaging case has minimal gaps. Preferably, the top flaps are rectangular in shape and the corner fold lines and the longitudinal axes of the perforation patterns are angled approximately 45° from the rectangular edges of their respective flaps.

In another variation, the blank for forming the reclosable packaging case includes graphics upon its top flaps for indicating whether the reclosable packaging case is properly closed or reclosed once the blank is formed into the reclosable packaging case. Each of the outer top flaps of the blank has an outer top graphic that complements an inner top graphic on an inner top flap of the blank. After the blank is used to form the reclosable packaging case and a portion of an outer top flap is correctly inserted into a corresponding opening in an inner top flap, the outer top flap's graphic and the inner top flap's graphic together establish an image that indicates to a user that the packaging case has been properly closed or reclosed and has minimal gaps.

The invention encompasses a method for forming and/or reclosing a reclosable packaging case to minimize gaps occurring in the reclosed packaging case. In accordance with the method, portions of one or more outer top flaps of the case are bent and inserted into openings in one or more inner top flaps of the case. In particular, the portions of the one or more outer flaps bent at pre-established angles and locations to ensure minimal gaps in the packaging case once the portions have been inserted into the openings in the inner top flaps.

Another method aspect of the invention covers forming and/or reclosing a reclosable packaging case including aligning graphics of inner and outer top flaps of the packaging case to ensure the packaging case is properly closed or reclosed and has minimal gaps. Each of the one or more outer top flaps of the reclosable packaging case has an outer top graphic that complements an inner top graphic on an inner top flap of the packaging case. When a portion of an outer top flap is correctly inserted into a corresponding opening in an inner top flap, the outer top flap's graphic and the inner top flap's graphic together establish an image that indicates to a user that the packaging case has been properly closed or reclosed and has minimal gaps.

Additional objects, features and advantages of the invention will become more readily apparent from the following detailed description of the invention when taken in conjunction with the drawings wherein like reference numerals refer to common parts in the several views.

DETAILED DESCRIPTION OF EMBODIMENTS

Figure 1:
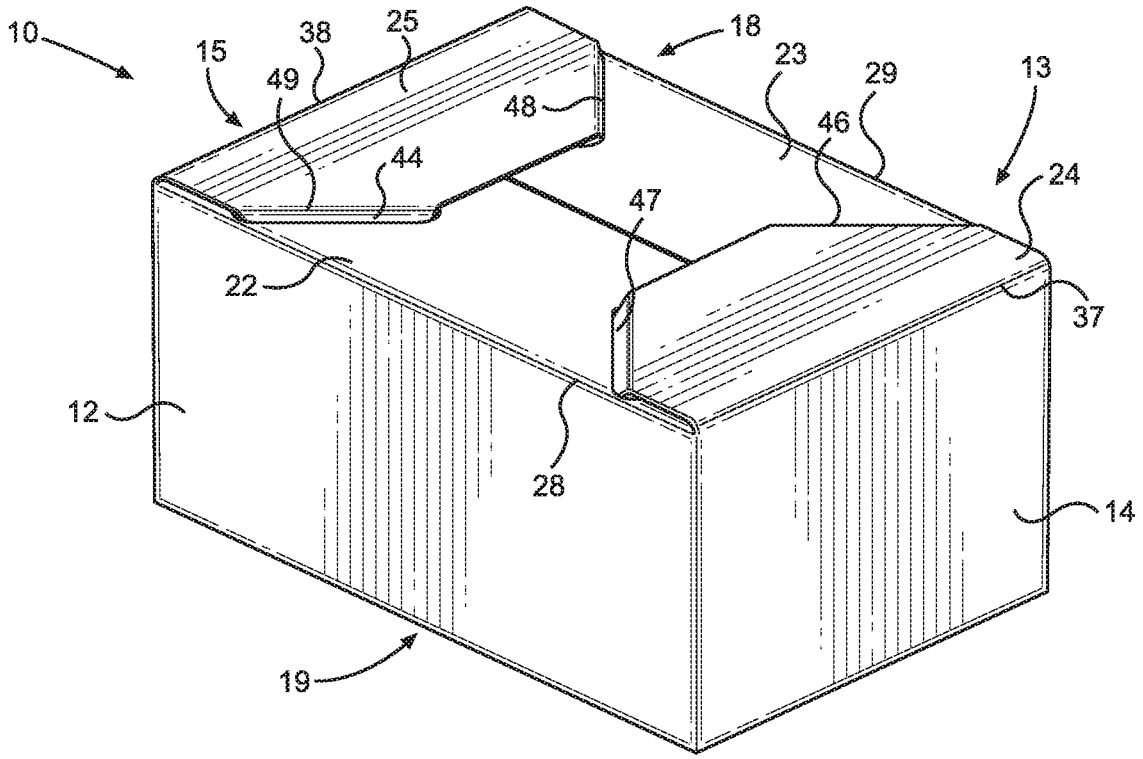
FIG. 1 is a perspective view of an embodiment of a reclosable packaging case constructed in accordance with the present invention in a closed or reclosed configuration.

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show particular details. Therefore, specific structural and functional details disclosed herein are not to be interpreted as limiting, but merely as a representative basis for teaching one skilled in the art to employ the present invention.

As used in this specification and the appended claims, the singular forms "a", "an" and "the" include plural referents unless the content clearly dictates otherwise. As used in this specification and the appended claims, the term "or" is generally employed in its sense including "and/or" unless the content clearly dictates otherwise.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom", as well as derivatives thereof (e.g., "horizontally," "downwardly," "upwardly," etc.), should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

Figure 2:
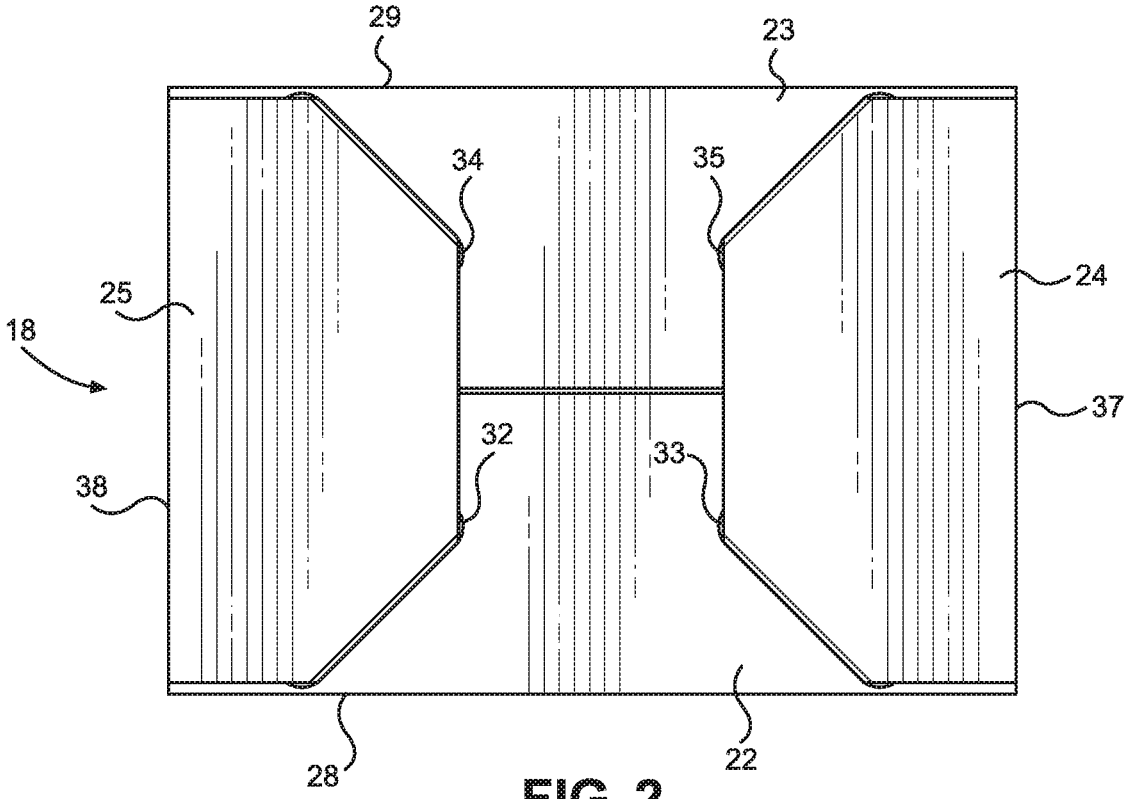
FIG. 2 is a top view of the case shown in FIG. 1.
Figure 3:
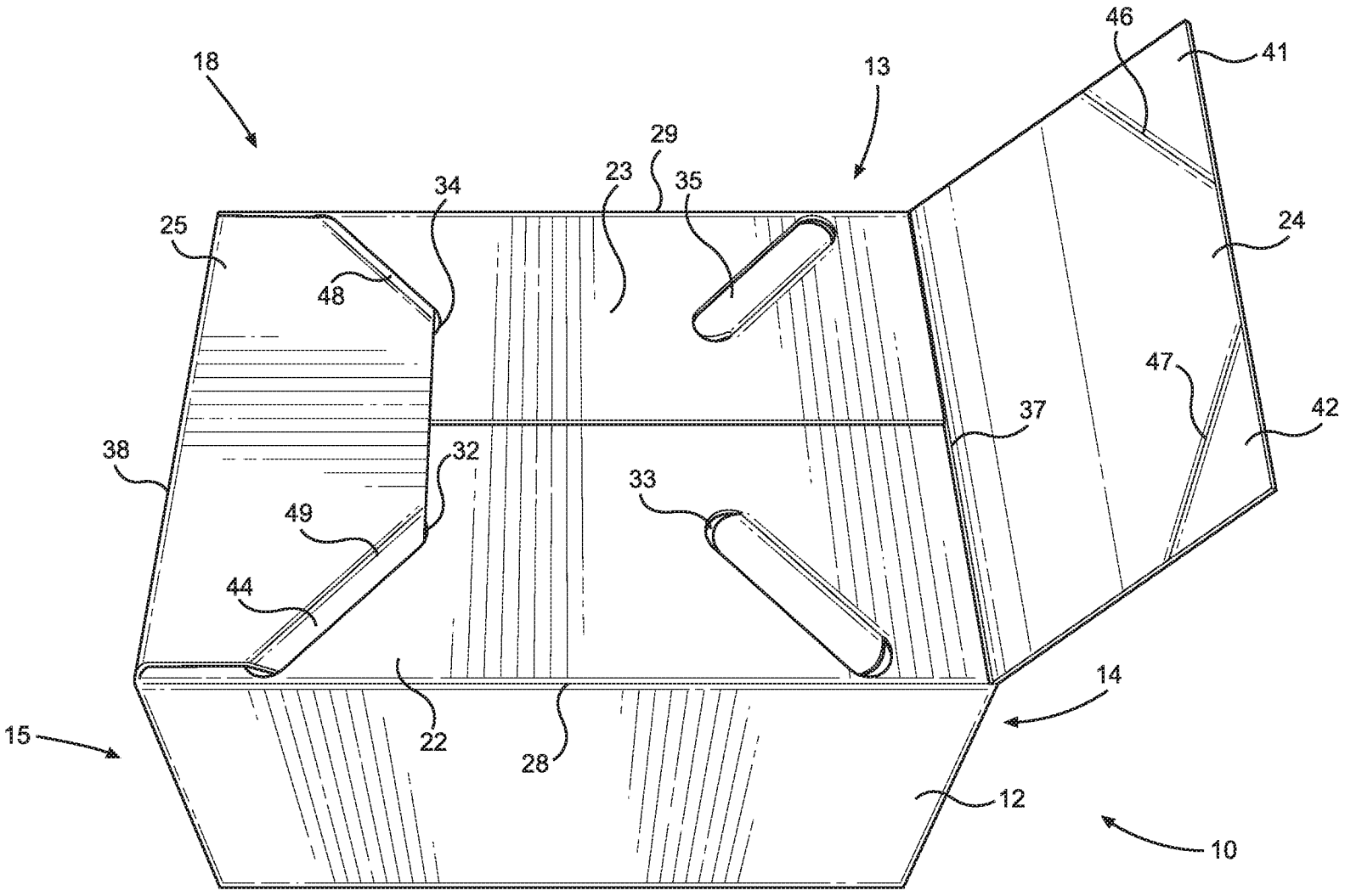
FIG. 3 is a top perspective view of the case shown in FIG. 1 in a partially closed or reclosed configuration.

With initial reference to FIGS. 1-3, there is shown a reclosable packaging case 10 in accordance with the present invention. FIGS. 1 and 2 show reclosable packaging case 10 in a closed or reclosed configuration, while FIG. 3 shows reclosable packaging case 10 in a partially closed or reclosed configuration. Preferably, reclosable packaging case 10 is made of a corrugated cardboard. However, the material composition of reclosable packaging case 10 is not limited to the preferred corrugated cardboard and can include one or more other materials known to those skilled in the art, including other paperboard products, for forming packaging cases while still functioning in accordance with the invention. Reclosable packaging case 10 has a pair of opposed side walls, first side wall 12 and second side wall 13, and a pair of opposed end walls, first end wall 14 and second end wall 15. Only one of each of the side and end walls, first side wall 12 and first end wall 14, are visible in the perspective view of FIG. 1. Packaging case 10 further has a top portion 18 and a bottom portion 19. Together, side walls 12 and 13, end walls 14 and 15, top portion 18 and bottom portion 19 enclose an interior (i.e., interior storage volume which is not labeled) of packaging case 10.

Top portion 18 covers the interior of packaging case 10 and includes a pair of inner top flaps, first inner top flap 22 and second inner top flap 23, and a pair of outer top flaps, first outer top flap 24 and second outer top flap 25. Preferably, each of top flaps 22-25 is rectangular in shape. However, it will be recognized by those skilled in the art that the shape of the top flaps can vary while still functioning in accordance with the invention. As shown in FIGS. 1 and 2, the first and second outer top flaps 24 and 25 at least partially cover the first and second inner top flaps 22 and 23 when packaging case 10 is in a closed or reclosed configuration.

First and second inner top flaps 22 and 23 are hingedly connected to first and second side walls 12 and 13, respectively, along first and second inner top fold lines 28 and 29, respectively. In particular, first and second inner top flaps 22 and 23 are intended to be folded inwardly towards one another along top fold lines 28 and 29, respectively, to at least partially cover the interior of packaging case 10. As perhaps best shown in part by the dashed outlines in FIG. 2, first top inner flap 22 has first and second openings 32 and 33 and second top inner flap 23 has third and fourth openings 34 and 35. Openings 32-35 are shown to be covered by outer top flaps 24 and 25 when packaging case 10 is in its closed or reclosed configuration (i.e., at least a majority of openings 32-35 is covered by outer top flaps 24 and 25). Preferably, openings 32-35 are entirely covered by outer top flaps 24 and 25. Openings 32-35 are sized to accommodate portions of outer top flaps 24 and 25 as described further below. Preferably, openings 32-35 are positioned and shaped as shown in FIG. 2 and angled approximately 45° relative to inner top fold lines 28 or 29. However, the openings provided in the inner top flaps of the reclosable packaging case are not limited to the preferred shapes, sizes, positions or angles shown in the figures and can be arranged in varying configurations while still functioning in accordance with the invention as will become more fully evident below.

Figure 4:
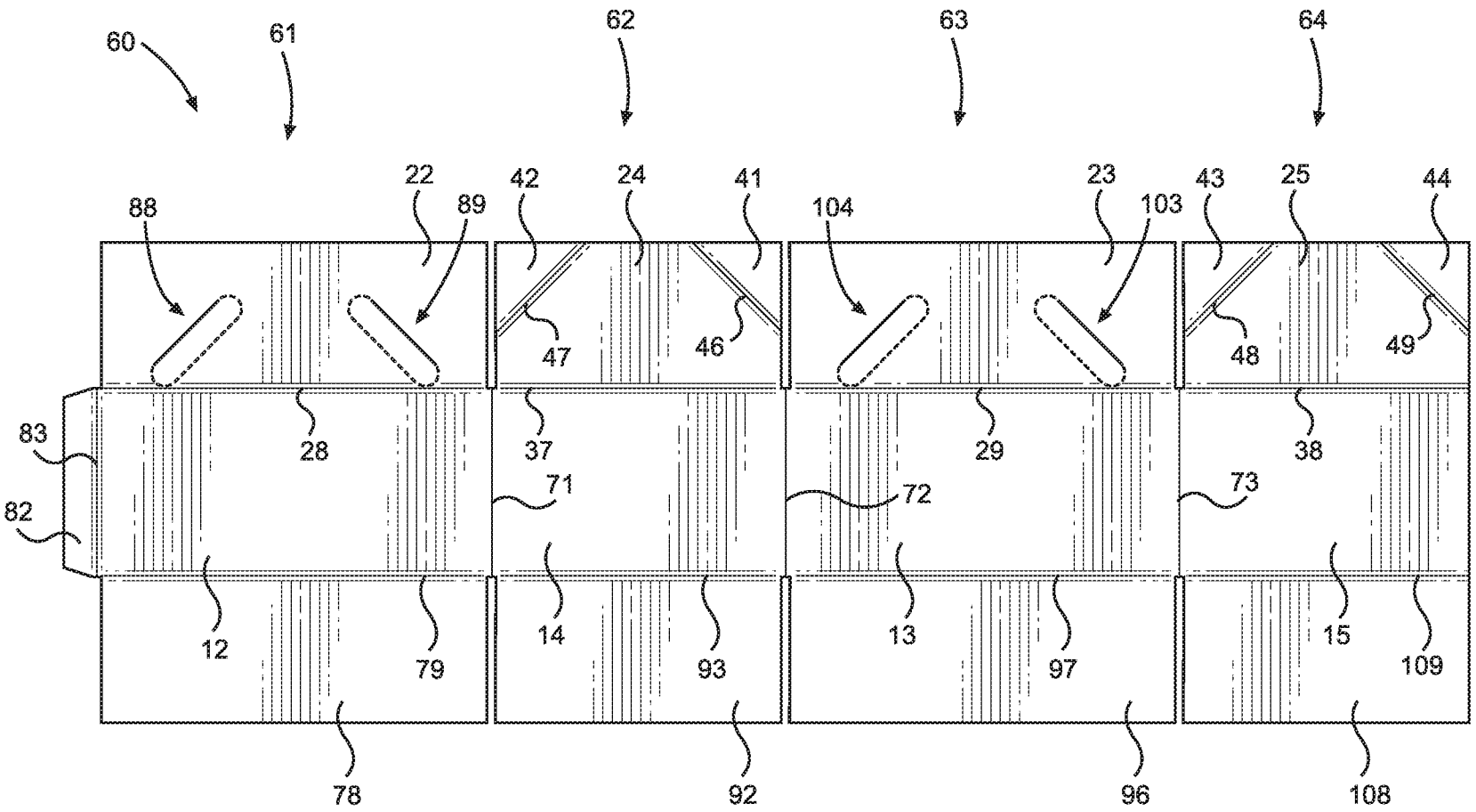
FIG. 4 is a top view of a unitary blank for forming the reclosable packaging case of FIGS. 1-3.

First and second outer top flaps 24 and 25 are hingedly connected to first and second end walls 14 and 15, respectively, along first and second outer top fold lines 37 and 38, respectively. Specifically, first and second outer top flaps 24 and 25 are folded at outer top fold lines 37 and 38, respectively, towards one another to at least partially cover the exterior surfaces of inner top flaps 22 and 23. Corner portions of outer top flaps 24 and 25 are inserted into openings 32-35 of inner flaps 22 and 23 when the reclosable packaging case is in its closed configuration as shown in FIGS. 1 and 2. In particular, first and second corner portions 41 and 42 of first outer top flap 24 are inserted into openings 35 and 33, respectively, and third and fourth corner portions 43 and 44 of second outer flap 25 are inserted into openings 34 and 28, respectively. Corner portions 41 and 42 can be seen in FIG. 3, while corner portions 43 and 44 are best seen in FIG. 4 as described below. Corner portions 41-44 are partially defined by and are bent relative to their respective outer top flap along corner fold lines 46-49, respectively. In the closed configuration of packaging case 10, first corner portion 41 is bent relative to first outer flap 24 along first corner fold line 46 towards the interior surface of first outer flap 24 and positioned in fourth opening 35. Corner portions 42-44 are similarly bent along corner fold lines 47-49, respectively, and positioned in openings 32-34, respectively. Preferably, when each corner portion is bent along its corner fold line relative to an outer top flap and inserted into a respective opening in an inner top flap, the corner portion is angled approximately 15° or less from the outer top flap. See, for example, the angle of corner portion 44 relative to top outer flap 25 in FIG. 3. Preferably, corner fold lines 46 and 47 are straight and angled approximately 45° relative to top outer fold line 37 and corner fold lines 48 and 49 are straight and angled approximately 45° relative to outer top fold line 38 as shown in the figures. The shapes, sizes, angles and positions of corner fold lines 46-49 are pre-established in order for corner portions 41-44 to sufficiently cover openings 32-35 when corner portions 41-44 are inserted therein and minimize gaps in packaging case 10.

With reference to FIG. 4, a blank 60, which is formed as a unitary or one-piece member and used to form reclosable packaging case 10, is shown. Blank 60 includes four panels: a first panel 61, a second panel 62, a third panel 63 and a fourth panel 64. First panel 61 is hingedly connected to second panel 62 along a first wall fold line 71, second panel is hingedly connected to third panel 63 along a second wall fold line 72 and third panel 63 is hingedly connected to fourth panel 64 along a third wall fold line 73. Fold lines of the current disclosure can include creased regions, perforations, or various other weakened regions to provide a predictable location at which bending or folding can occur. One skilled in the art would understand that the inclusion of various types of fold lines known in the art would be within the scope of the current disclosure.

First panel 61 includes first side wall 12 hingedly connected to first inner top flap 22 along first inner top fold line 28, a first bottom flap 78 along a first bottom fold line 79, and second panel 62 along first wall fold line 71. First panel 61 further includes a connecting flap 82 hingedly connected to first side wall 12 along a connecting fold line 83. Connecting flap 82 is used to connect first panel 61 to fourth panel 64 as described further below regarding a method for forming reclosable packaging case 10 using blank 60. In blank 60, first inner top flap 22 does not have first and second openings 32 and 33 but rather a first perforation pattern 88 and a second perforation pattern 89. The portions (not separately labeled) of first inner top flap 22 that are enclosed by first perforation pattern 88 or second perforation pattern 89 are to be at least partially detached from first inner top flap 22 to form first opening 32 or second opening 33, respectively, when reclosable packaging box 10 is in its closed or partially closed configuration as shown in FIGS. 1-3. As shown, each portion of first inner top flap 22 defined by first or second perforation patterns 88 or 89 is only to be partially detached from first inner top flap 22 in order to establish a hinged tab (not separately labeled) that defines, at least in part, the formed opening 32 or 33. The hinged tab that is formed and extends into opening 33 is best seen in FIG. 3. In an alternative embodiment, first inner top flap 22 already has one or both of openings 32 or 33 formed therein. Preferably, the central longitudinal axis of first perforation pattern 88 and the central longitudinal axis of second perforation pattern 89 are each angled approximately 45° from first inner top fold line 28. However, other angles, sizes and positions of perforation patterns than shown in FIG. 4 could be employed. What is important is that perforation patterns 88 and 89 allow second and fourth corner portions 42 and 44, respectively, to be inserted into second and first openings 33 and 32, respectively.

Second panel 62 of blank 60 includes first end wall 14 hingedly connected to first panel 61 along first wall fold line 71, third panel 63 along second wall fold line 72, first outer top flap 24 along first outer top fold line 37, and a second bottom flap 92 along a second bottom fold line 93. First outer top flap 24 has first and second corner portions 41 and 42 that are at least partially defined by first and second corner fold lines 46 and 47, respectively. Preferably, each of first and second corner fold lines 46 and 47 is a straight line angled approximately 45° from first outer top fold line 37. However, other shapes, angles, sizes and positions of corner fold lines than shown in FIG. 4 could be employed. What is important is that first and second corner fold lines 46 and 47 are positioned to enable first and second corner portions 41 and 42 to be inserted into second and fourth openings 33 and 35, respectively.

Third panel 63 includes second side wall 13 hingedly connected to second panel 62 along second wall fold line 72, second inner top flap 23 along second inner top fold line 29, a third bottom flap 96 along a third bottom fold line 97, and fourth panel 64 along third wall fold line 73. In blank 60, second inner top flap 23 does not have third and fourth openings 34 and 35 but rather a third perforation pattern 103 and a fourth perforation pattern 104. The portions (not separately labeled) of second inner top flap 23 which are enclosed by third perforation pattern 103 or fourth perforation pattern 104 are to be at least partially detached from second inner top flap 23 to form third opening 34 or fourth opening 35, respectively, when reclosable packaging box 10 is in its closed or partially closed configuration as shown in FIGS. 1-3. As shown, each portion of second inner top flap 23 defined by third or fourth perforation patterns 103 or 104 is only to be partially detached from second inner top flap 23 in order to establish a hinged tab (not separately labeled) that defines, at least in part, the formed opening 34 or 35. The hinged tab that is formed and extends into opening 35 is best seen in FIG. 3. In an alternative embodiment, second inner top flap 23 already has one or both of openings 34 or 35 formed therein. Preferably, the central longitudinal axis of third perforation pattern 103 and the central longitudinal axis of fourth perforation pattern 104 are each angled approximately 45° from second inner top fold line 29. However, other angles, sizes and positions of perforation patterns than shown in FIG. 4 could be employed. What is important is that perforation patterns 103 and 104 allow third and first corner portions 43 and 41, respectively, to be inserted into third and fourth openings 34 and 35, respectively.

Fourth panel 62 of blank 60 includes second end wall 15 hingedly connected to third panel 63 along third wall fold line 73, second outer top flap 25 along second outer top fold line 38, and a fourth bottom flap 108 along a fourth bottom fold line 109. Second outer top flap 25 has third and fourth corner portions 43 and 44 that are at least partially defined by third and fourth corner fold lines 48 and 49, respectively. Preferably, third and fourth corner fold lines 48 and 49 are each angled approximately 45° from second outer top fold line 38. However, other angles, sizes and positions of corner fold lines than shown in FIG. 4 could be employed. What is important is that third and fourth corner fold lines 48 and 49 allow third and fourth corner portions 43 and 44, respectively, to be inserted into first and third openings 32 and 34, respectively, to retain the outer top flaps atop the inner top flaps.

With reference to FIGS. 1-4, the present invention also pertains to a method of forming a reclosable packaging case. Starting with blank 60, having perforation patterns 88, 89, 103 and 104 and corner fold lines 46-49 at pre-established angles, sizes and positions that allow corner portions 41-44 to be inserted into openings 32-35 such that minimal gaps occur in the closed configuration of packaging case 10 as set forth above, panels 61-64 are folded toward one another along wall fold lines 71-73 and connecting flap 82 is folded inwardly relative to first panel 61 along connecting fold 83 and attached to the edge of fourth panel 64 opposite wall fold line 73 to partially establish the rectangular interior of packaging case 10. Bottom flaps 78, 92, 96 and 108 are folded inwardly to further enclose the rectangular interior of packaging case 10 and secured by one or more means known to those skilled in the art, such as an adhesive or tape. The interior of the packaging case 10, enclosed by side walls 12 and 13, end walls 14 and 15 and bottom 18, is filled with a product to be packaged by reclosable packaging case 10. The design of packaging case 10 is seen to be particularly advantageous for use in packaging a frozen dough product. In any case, after the product is placed within the interior of packaging case 10, top inner flaps 22 and 23 are folded inwardly along top inner fold lines 39 and 29, respectively, to at least partially cover the interior. Portions of top inner flaps 22 and 23 delineated by perforation patterns 88, 89, 103 and 104 are preferably partially detached from their respective inner top flaps to create openings 32-35, respectively, with hinged tabs (not separately labeled) depending therefrom. See, for example, the hinged tabs at openings 33 and 35 in FIG. 3. Alternatively, the portions delineated by perforation patterns 88, 89, 103 and 104 are entirely detached from their respective inner top flaps to create openings 32-35, respectively. After top inner flaps 22 and 23 are folded to at least partially cover the interior of packaging case 10, each of corner portions 41-44 of top outer flaps 24 and 25 is folded inwardly along its respective corner fold lines relative to its respective top outer flap. After or while corner portions 41-44 are being folded, top outer flaps 24 and 25 are folded inwardly along top outer fold lines 37 and 38, respectively, to at least partially cover top inner flaps 22 and 23. Corner portions 41-44 are inserted into openings 32-35 to form a closed configuration of reclosable packaging case 10 as shown in FIG. 1. Preferably, when each corner portion is bent along its corner fold line relative to an outer top flap and inserted into a respective opening in an inner top flap, the corner portion is angled approximately 15° or less from the outer top flap. See, for example, the angle of corner portion 44 relative to top outer flap 25 in FIG. 3.

In an alternative embodiment, corner portions 41-44 are not folded and inserted into openings 32-35 to initially form the packaging case. Rather, top outer flaps 24 and 25 are folded relative to end walls 14 and 16, respectively, without folding corner portions 41-44, and secured to top inner flaps 22 and 23 by means already known to those skilled in the art. Once the packaging case is formed and opened for the first time, corner portions 41-44 can then be folded inwardly along their respective corner fold lines relative to their respective top outer flaps and then inserted into openings 32-35 to reclose the packaging case.

The present invention also pertains to a method of reclosing a reclosable packaging case after it has been opened. After reclosable packaging case 10 is opened, e.g., by unfolding one or more of top flaps 22-25 away from the interior of the packaging case, reclosable packaging case 10 can be reclosed in a manner which advantageously minimizes any gaps in the reclosed packaging case. More specifically, top inner flaps 22 and 23 are folded inwardly along top inner fold lines 39 and 29, respectively, to at least partially cover the interior. Then each of corner portions 41-44 of top outer flaps 24 and 25 is folded inwardly along its respective corner fold lines relative to its respective top outer flap. After or while corner portions 41-44 are being folded, top outer flaps 24 and 25 are folded inwardly along top outer fold lines 37 and 38, respectively, to at least partially cover top inner flaps 22 and 23. Then, corner portions 41-44 are inserted into openings 32-35 to form a closed configuration of reclosable packaging case 10 as shown in FIG. 1. Preferably, when each corner portion is bent along its corner fold line relative to an outer top flap and inserted into a respective opening in an inner top flap, the corner portion is angled about 15° or less from the outer top flap. See, for example, the angle of corner portion 47 relative to top outer flap 24 in FIG. 1.

Figure 5:
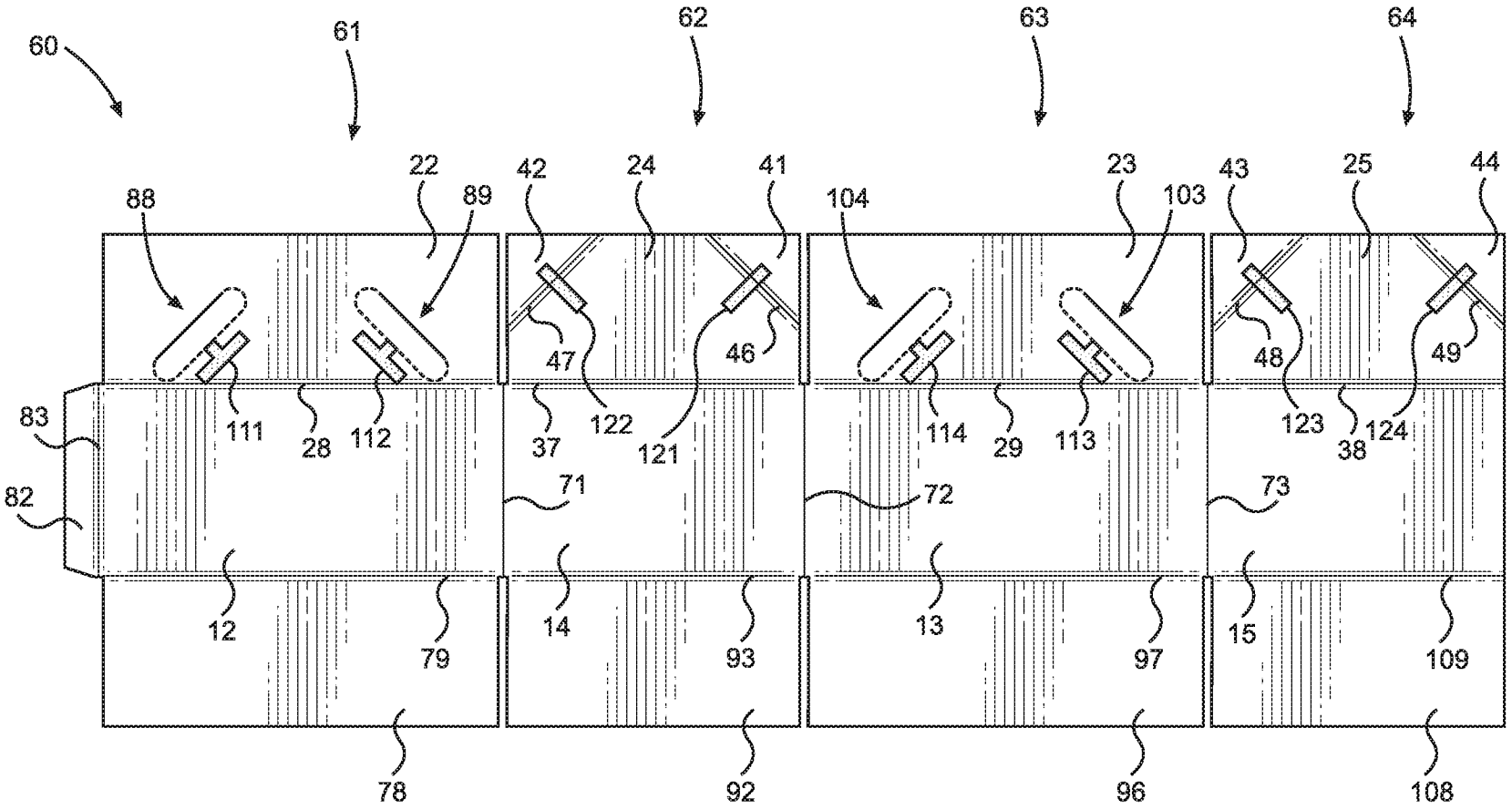
FIG. 5 is a top view of another embodiment of a blank in accordance with the present invention for forming a reclosable packaging case, the blank including graphic elements for indicating whether the reclosable packaging case is properly closed or reclosed.
Figure 6:
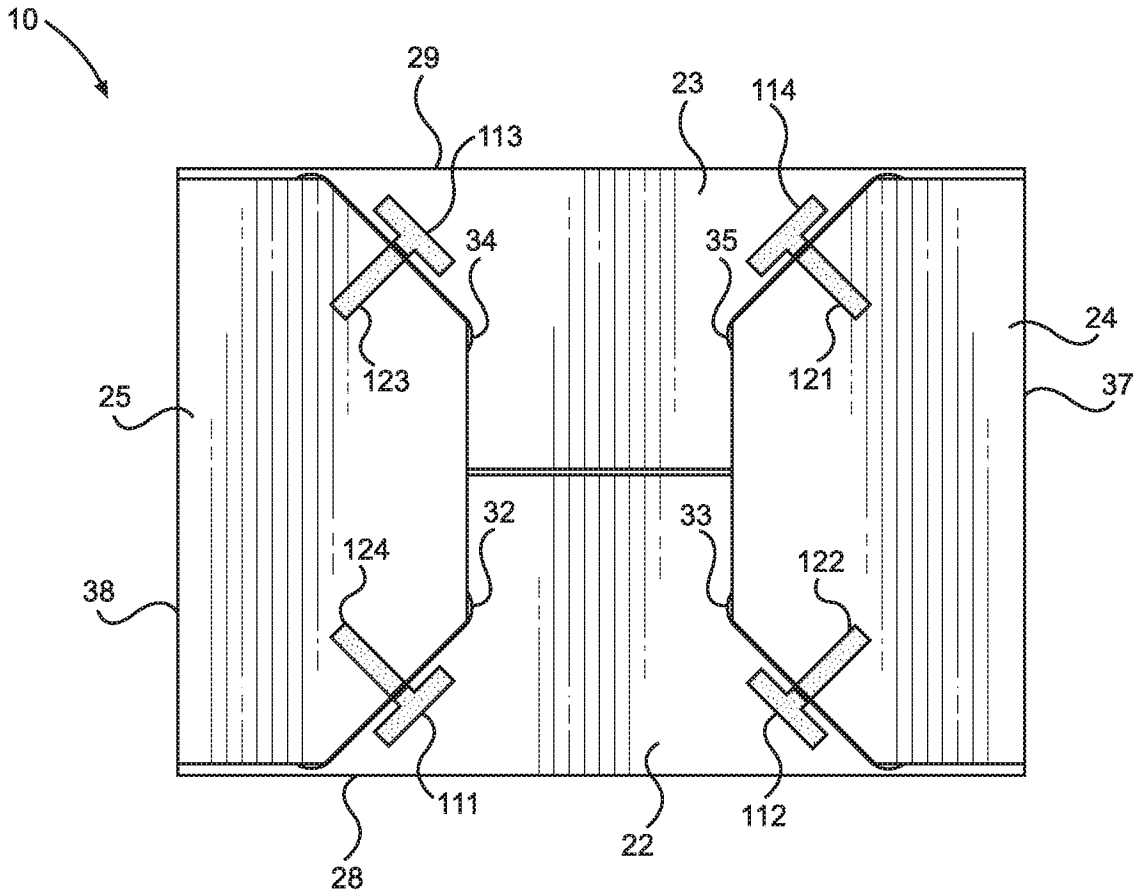
FIG. 6 is a top view of a reclosable packaging case formed from the blank shown in FIG. 5.

In a modified embodiment of the present invention represented in FIGS. 5 and 6, blank 60 further includes graphic elements upon top flaps 22-25 which help indicate that packaging case 10 is properly closed or reclosed. In particular, first inner top flap 22 includes first and second inner graphics 111 and 112, each shown in the shape of the top half of a letter "T", extending from and perpendicular to first and second perforation patterns 88 and 89, respectively, towards first inner top fold line 28. Similar to first inner top flap 22, second inner top flap 23 includes third and fourth graphics 113 and 114, each in the shape of the top half of a letter "T", extending from and perpendicular to third and fourth perforation patterns 103 and 104, respectively, towards second inner top fold line 29. First outer top flap 24 includes first and second outer graphics 121 and 122, each in the shape of a narrow rectangle, extending across and perpendicular to first and second corner lines 46 and 47, respectively. Similar to first outer top flap 24, second outer top flap 25 includes third and fourth outer graphics 123 and 124, each in the shape of a narrow rectangle, extending across and perpendicular to third and fourth corner lines 48 and 49, respectively. As shown in FIG. 6, when blank 60 is folded to form reclosable packaging case 10 and corner portions 41-44 are properly inserted into openings 32-35 created from perforated patterns 88, 89, 103 and 104 (i.e., corner portions 41-44 are inserted into openings such that outer flaps 24 and 25 cover a majority of the openings and minimize gaps), inner graphics 111-114 align with outer graphics 124, 122, 123 and 121, respectively, to form complete "T" shaped graphics. The resulting complete "T" shaped graphics (not separately labeled) indicate to a user that packaging case 10 has been properly closed or reclosed and that gaps in packaging case 10 have been minimized. While "T" shaped graphics have been exemplified herein, other aligning graphical elements could be employed. What is important is that when the corner portions of the outer top flaps are properly inserted into the openings in the inner top flaps, one or more images is formed to indicate to a user that the packaging case has been properly closed or reclosed.

Although described with respect to preferred embodiments of the invention, it should be recognized that various changes and/or modifications could be made to the invention without departing from the spirit thereof. In general, the invention is only intended to be limited by the scope of the following claims.

The invention claimed is:

1. A unitary blank for forming a reclosable packaging case, the blank comprising:

a plurality of interconnected panels including a first panel connected to a second panel along a wall fold line, the first panel including an inner top flap having an opening or a perforation pattern configured to establish the opening, and the second panel including an outer top flap having a corner fold line that partially defines a corner portion, wherein the corner portion of the outer top flap is configured to bend along the corner fold line and position in the opening or through the perforation pattern to retain the outer top flap atop the inner top flap, wherein the inner top flap further includes an inner graphic adjacent to the opening or perforation pattern and the outer top flap includes an outer graphic that extends across the corner fold line, said inner and outer graphics being configured to align and form an image only when the corner portion is inserted into the opening, the outer top flap covers a majority of the opening, and the reclosable packaging case is properly closed.

2. The blank of claim 1, wherein the first panel further includes a wall connected to the inner top flap along an inner top fold line, and the opening or the perforation pattern has a longitudinal axis that is angled relative to the inner top fold line.

3. The blank of claim 2, wherein the longitudinal axis of the opening or the perforation pattern is angled approximately 45° relative to the inner top fold line.

4. The blank of claim 1, wherein the second panel further includes a wall connected to the outer top flap along an outer top fold line, and the corner fold line is angled relative to the outer top fold line.

5. The blank of claim 4, wherein the longitudinal axis of the corner fold line is angled approximately 45° relative to the outer top fold line.

6. The blank of claim 1, wherein the inner top flap has the perforation pattern configured to establish the opening and the perforation pattern is further configured to establish a hinged tab defining, at least in part, the opening.

7. The blank of claim 1, wherein the inner top flap further includes a second opening or a second perforation pattern configured to establish the second opening and the outer top flap panel further includes a second corner fold line partially defining a second corner portion.

8. The blank of claim 7, wherein the plurality of interconnected panels further includes a third panel having a second inner top flap having a third opening or a third perforation pattern configured to establish the third opening, the second corner portion of the outer top flap is configured to bend along the second corner fold line and the third opening is configured to accommodate the second corner portion.

9. A unitary blank for forming a reclosable packaging case, the blank comprising a plurality of interconnected panels including a first panel connected to a second panel along a wall fold line, the first panel including an inner top flap connected to a wall along an inner top fold line, the inner top flap formed with an opening entirely spaced from the inner top fold line, and the second panel including an outer top flap having a corner fold line that partially defines a corner portion, wherein the corner portion of the outer top flap is configured to bend along the corner fold line and be positioned in the opening to retain the outer top flap atop the inner top flap, wherein the opening is defined, in part, by a hinged tab portion of the inner top flap engaging the outer top flap when the outer top flap is positioned in the opening, wherein the inner top flap further includes an inner graphic adjacent to the opening and the outer top flap includes an outer graphic that extends across the corner fold line, said inner and outer graphics being configured to align and form an image only when the corner portion is inserted into the opening, the outer top flap covers a majority of the opening, and the reclosable packaging case is properly closed.

10. A reclosable packaging case comprising:

a plurality of interconnected panels formed from a unitary blank and establishing an interior for the packaging case, the plurality of interconnected panels including a first panel connected to a second panel, the first panel including an inner top flap having an opening or a perforation pattern configured to establish the opening, and the second panel including an outer top flap having a corner fold line that partially defines a corner portion, wherein the corner portion of the outer top flap is configured to bend along the corner fold line and in the opening or through the perforation pattern to retain the outer top flap atop the inner top flap, wherein the inner top flap further includes an inner graphic adjacent to the opening, the outer top flap includes an outer graphic that extends across the corner fold line, said inner and outer graphics being configured to form an aligned image only when the corner portion is inserted into the opening and the outer top flap covers a majority of the opening, wherein the image indicates that the reclosable packaging case is properly closed.

11. The reclosable packaging case of claim 10, wherein the outer flap is configured to cover a majority of the opening when the corner portion is inserted into the opening.

12. The reclosable packaging case of claim 10, wherein the first panel further includes a wall connected to the inner top flap along an inner top fold line, and the opening has a longitudinal axis that is angled relative to the inner top fold line.

13. The reclosable packaging case of claim 12, wherein the longitudinal axis of the opening is angled approximately 45° relative to the inner top fold line.

14. The reclosable packaging case of claim 10, wherein the second panel further includes a wall connected to the outer top flap along an outer top fold line, and the corner fold line is angled relative to the outer top fold line.

15. The reclosable packaging case of claim 14, wherein the longitudinal axis of the corner fold line is angled approximately 45° relative to the outer top fold line.

16. The reclosable packaging case of claim 10, wherein the inner top flap has the perforation pattern configured to establish the opening and the perforation pattern is further configured to establish a hinged tab defining, at least in part, the opening.

17. A method of reclosing a reclosable packaging case after the reclosable packaging case has been opened, the reclosable packaging case being formed from a unitary blank and having a plurality of interconnected panels establishing an interior and including a first panel connected to a second panel, the first panel including an inner top flap having an opening, and the second panel including an outer top flap having a corner fold line that partially defines a corner portion, wherein the inner top flap further includes an inner graphic adjacent to the opening, the outer top flap includes an outer graphic that extends across the corner fold line, said inner and outer graphics being configured form an aligned image only when the corner portion is inserted into the opening and the outer top flap covers a majority of the opening, wherein the image indicates that the reclosable packaging case is properly closed, the method comprising:

folding the inner top flap to at least partially cover the interior;

bending the corner portion relative to the outer top flap along the corner fold line;

folding the outer top flap to at least partially cover the inner top flap;

inserting the bended corner portion into the opening, covering a majority of the opening with the outer top flap; and aligning the inner and outer graphics to form the image.

* * * * *